US006526601B1

(12) United States Patent
Kou Hsiao

(10) Patent No.: US 6,526,601 B1
(45) Date of Patent: Mar. 4, 2003

(54) DRAIN CLEANER WITH A HIGH PRESSURE CAN

(76) Inventor: Min-Lan Kou Hsiao, 12109 Carlsbad Dr., Austin, TX (US) 78738

( * ) Notice: Subject to any disclaimer, the term of this patent is extended or adjusted under 35 U.S.C. 154(b) by 0 days.

(21) Appl. No.: 10/050,125

(22) Filed: Jan. 18, 2002

(51) Int. Cl.[7] ..... E03D 9/00
(52) U.S. Cl. ..... 4/255.01; 222/162
(58) Field of Search ..... 4/255.01, 255.04, 4/255.06; 222/162, 325

(56) References Cited

U.S. PATENT DOCUMENTS 2,999,264 A * 9/1961 Stearns ..... 4/255.01 X
3,138,803 A * 6/1964 Caplan et al. ..... 4/255.01
3,534,890 A * 10/1970 Iannacone ..... 222/325 X
4,034,427 A * 7/1977 Breznock et al. ..... 4/255.01

* cited by examiner

*Primary Examiner*—Robert M. Fetsuga
(74) *Attorney, Agent, or Firm*—Rosenberg, Klein & Lee

(57) ABSTRACT

A drain cleaner includes a casing having a tube engaged with an opening in the first end of the casing and the tube has a shrink opening on a top surface thereof. A high pressure can is received in the casing and includes a valve which is located in alignment with the shrink opening of the tube. A rod movably extends through a second end of the casing so as to push the can to let the valve be activated by the shrink opening and a high pressure is generated through the tube.

10 Claims, 6 Drawing Sheets

DRAIN CLEANER WITH A HIGH PRESSURE CAN

FIELD OF THE INVENTION

The present invention relates to a drain cleaner which is cooperated with a high pressure can to generate a high pressure to clean the drain.

BACKGROUND OF THE INVENTION

There are two types of conventional drain cleaners for remove stuff stocked in the sink drains or even toilet pipes, one of which includes a snake which is a flexible cable and extends through the drains to penetrate the stuff in the drains. The other one is a plunger which has a cup connected to a handle so as to seal the opening of the drain and when the handle is pushed downward, a pressure is generated by the deformation of the cup and hopefully to remove the stuff in the drain. Nevertheless, both of the two conventional drain cleaners are not satisfied by the users. The snake is so tiny that cannot make a larger hole through the stuff and the snake is too soft that the snake cannot go through the trap of the drain. The cup of the plunger can only generate a limited pressure when pushing the handle and the pressure cannot last for a long distance to remove the stuff at the remote position in the drain.

SUMMARY OF THE INVENTION

In accordance with one aspect of the present invention, there is provided a drain cleaner which comprises a casing having an aperture defined in a first end thereof and a tube is engaged with the opening. A high pressure can is received in the casing and includes a valve which is located in alignment with a shrink opening of the tube. A spring is connected between the can and an inside of the first end of the casing. A rod movably extends through a second end of the casing is pushed to move the can to generate a high pressure through the tube.

The primary object of the present invention is to provide a drain cleaner that generates a high pressure by a high pressure can in the device to remove the stuff in the drain.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
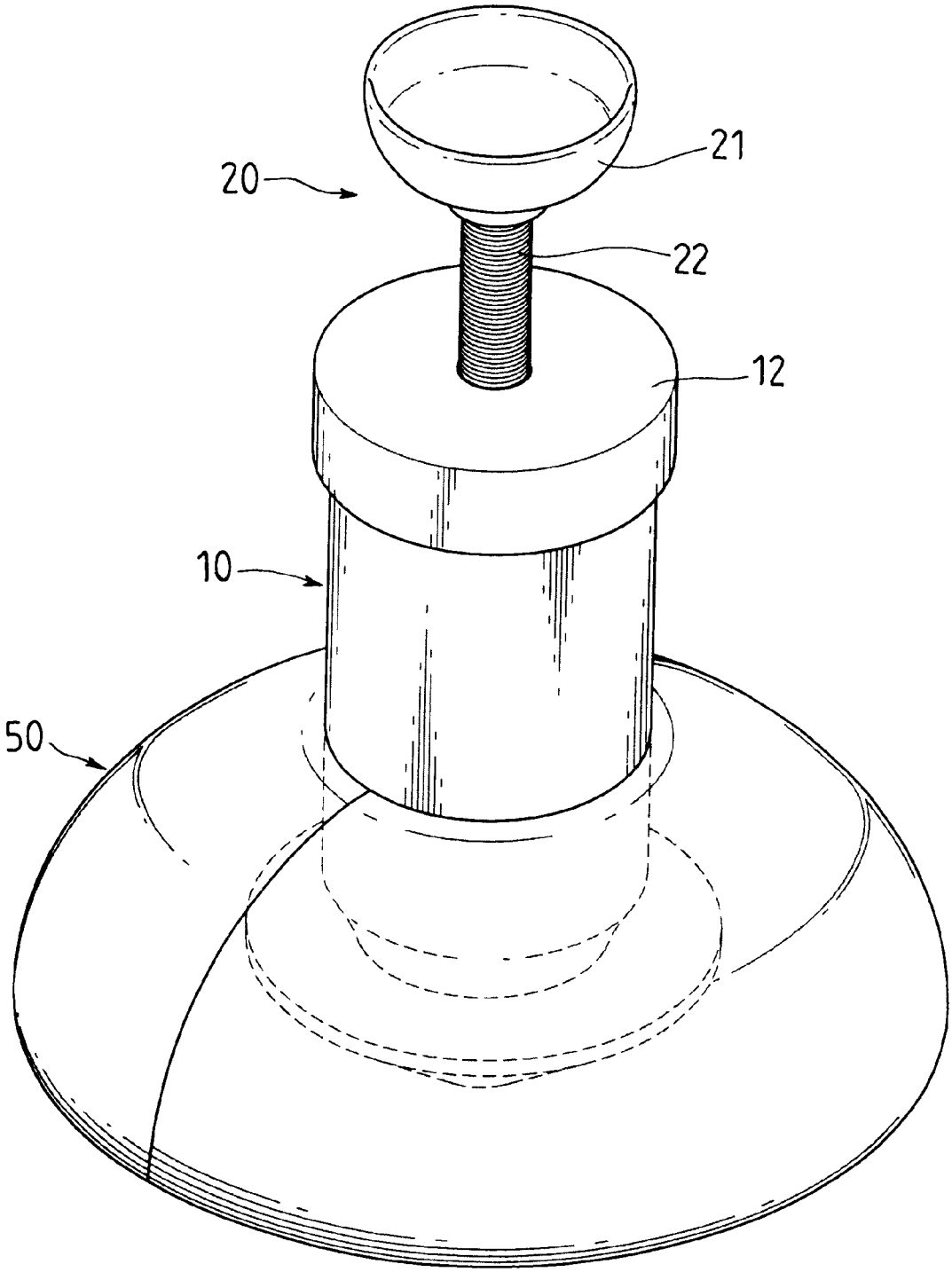
FIG. 1 is a perspective view to show the drain cleaner of the present invention.
Figure 2:
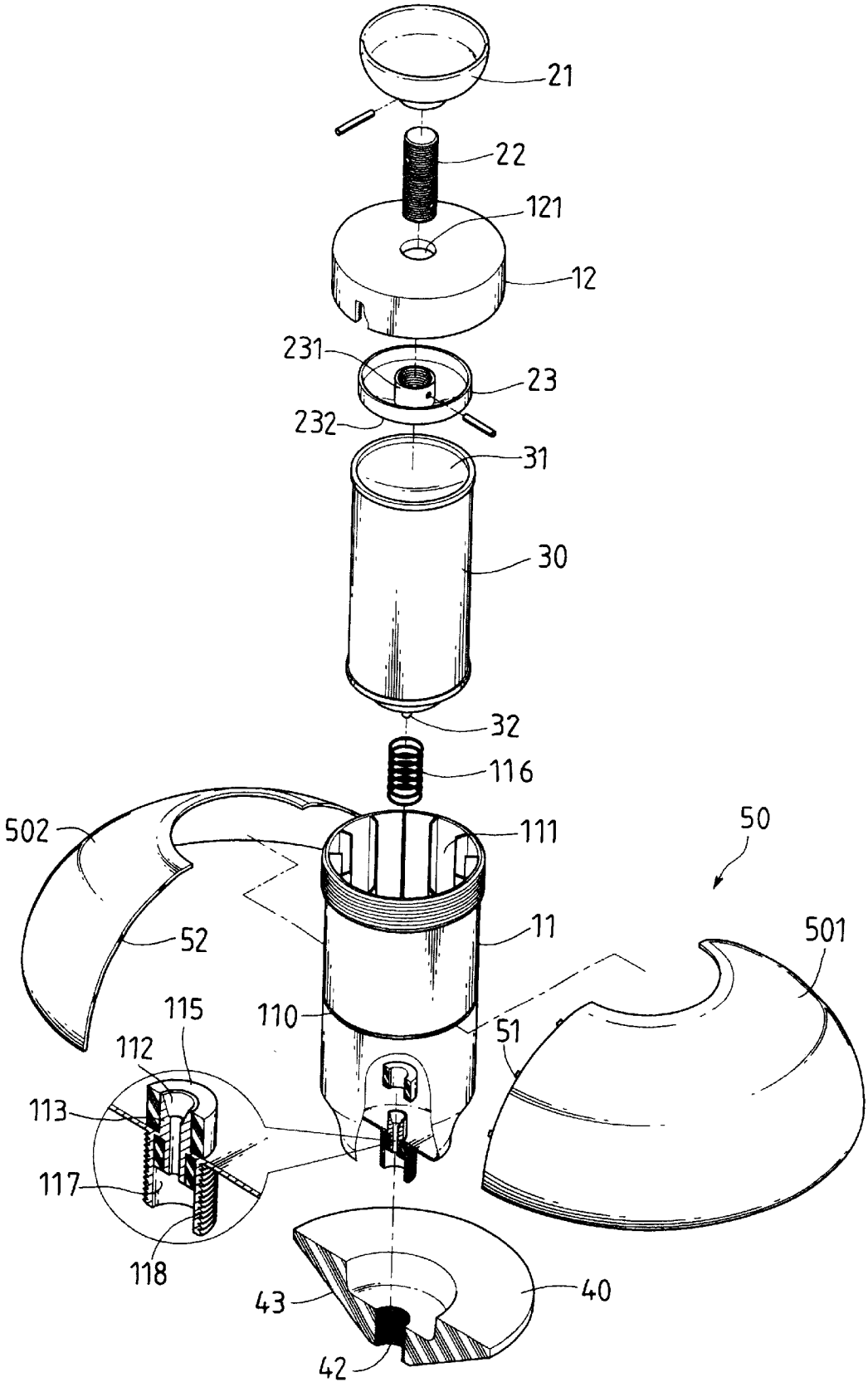
FIG. 2 is an exploded view to show the drain cleaner of the present invention.
Figure 3:
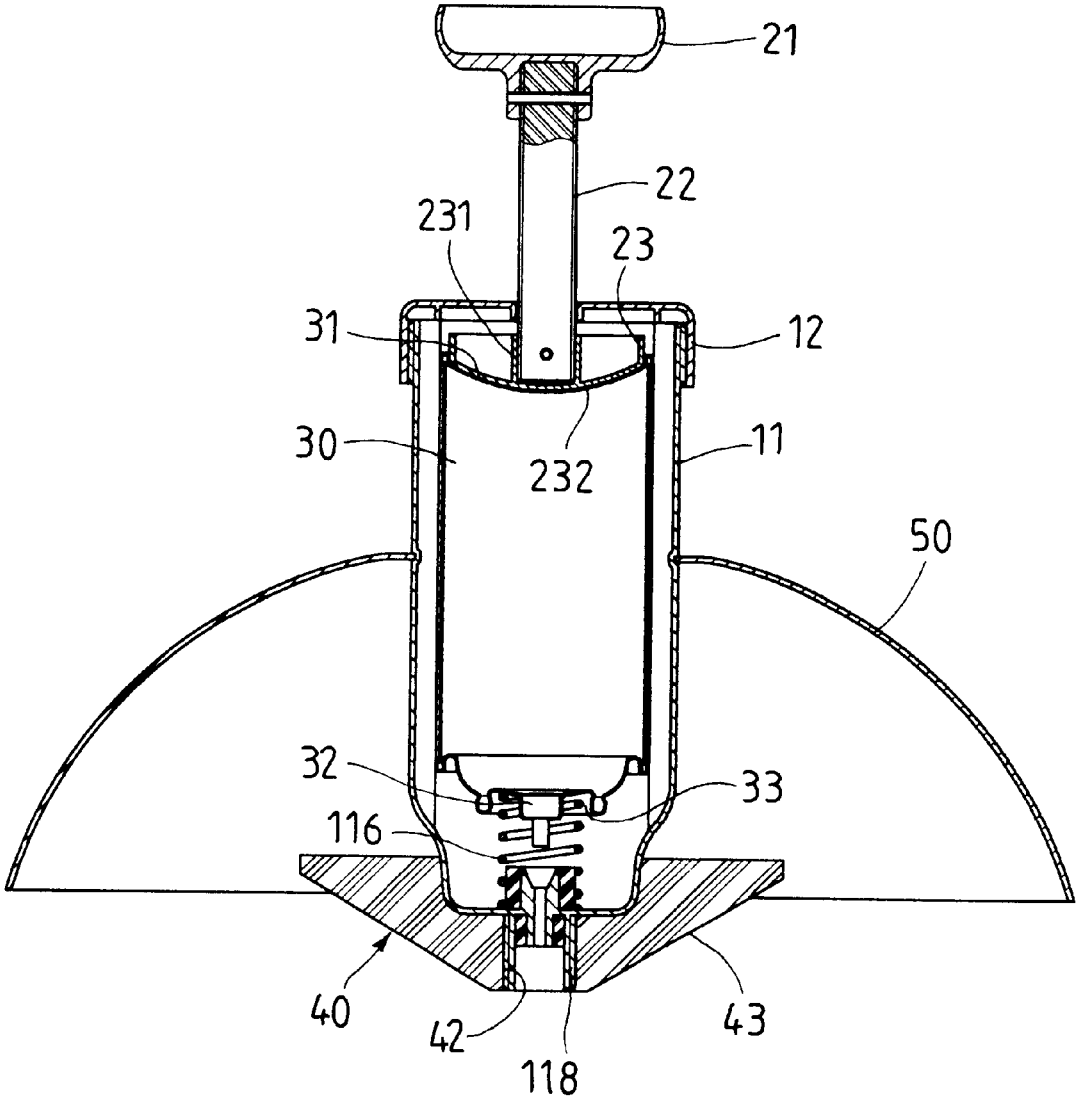
FIG. 3 is a cross sectional view to show the drain cleaner of the present invention.

Referring to FIGS. 1 to 3, the drain cleaner of the present invention comprises a casing 11 having an aperture 117 defined in a first end thereof and a cap 12 is removably mounted to a second end of the casing 11. A tube 113 is engaged with the opening 117 and has a shrink opening 112 defined in a top surface thereof. A bush 115 is mounted on the tube 113 and located on the inside of the first end of the casing 11.

A high pressure can 30 received in the casing 11 and a plurality of ribs 111 extend from an inside of the casing 11 so that the can 30 is enclosed and positioned by the ribs 111. A valve 32 is connected to a first end of the can 30 and a recess 33 is defined in the first end of the can 30 and around the valve 32. A spring 116 has an end received in the recess 33 and the other end is mounted to the bush 115. The valve 32 is located in alignment with the shrink opening 112 of the tube 113.

A rod 22 movably extends through a hole 121 in the cap 12 on the second end of the casing 11 and a curved plate 23 having a curved surface 232 is connected to the rod 22. The curved surface contacts a concavity 31 defined in the second end of the can 30. The curved plate 23 has an inner-threaded tube 231 extending therefrom and the rod 22 is threadedly engaged with the inner-threaded tube 231. A knob 21 is threadedly connected to the other end of the rod 22.

A connection member 118 is fixedly mounted on the tube 113 and is located at an outside of the first end of the casing 11. The connection member 118 has threads on an outer periphery thereof and a drain engagement device such as a cone-shaped pad 40 has a threaded passage 42 which is engaged with the threads of the connection member 118.

The casing 11 has an annular groove 110 defined in an outer periphery thereof and a skirt member 50 includes two halves 501, 502 which are respectively engaged with the annular groove 110 in the casing 11.

Figure 4:
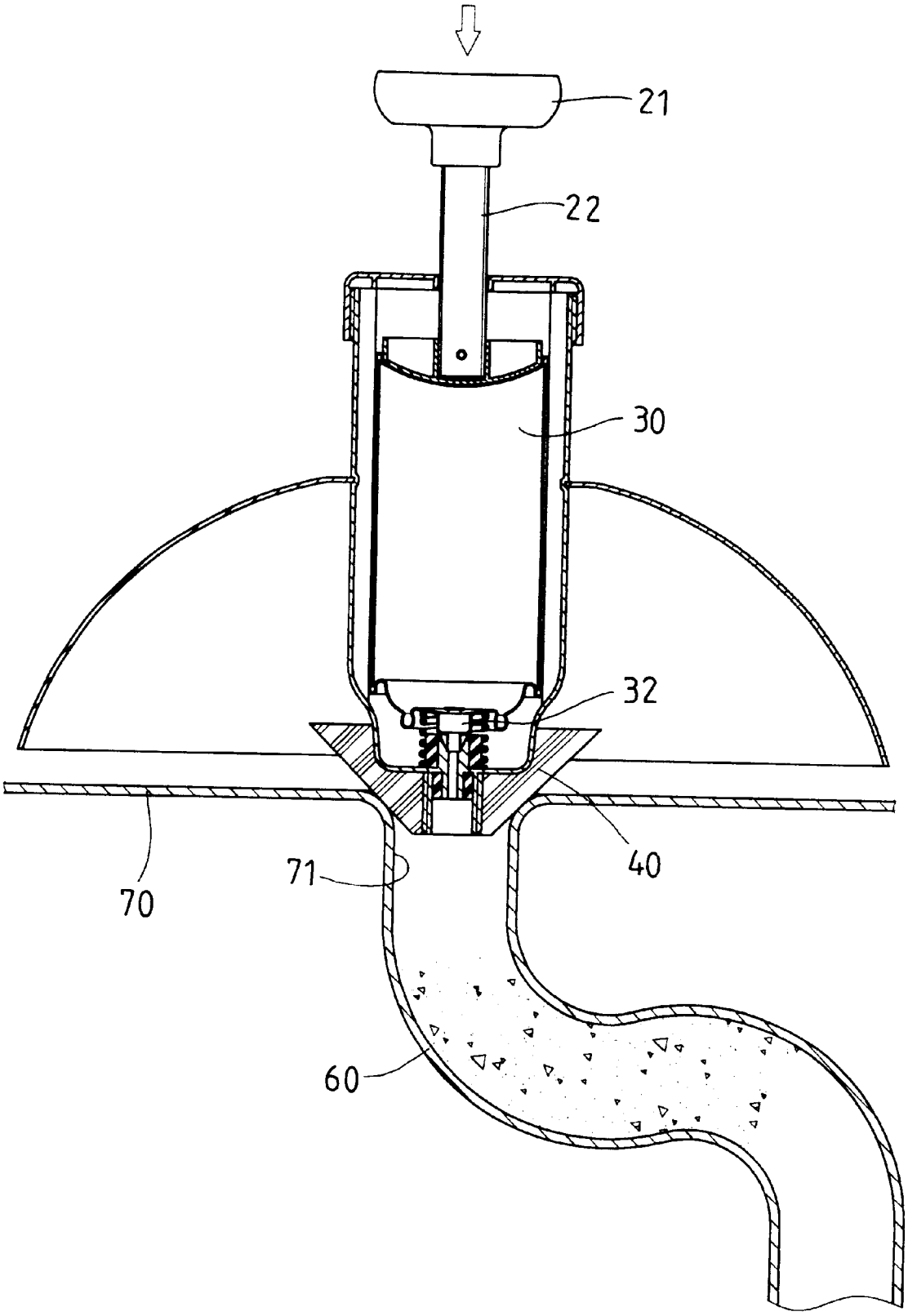
FIG. 4 shows that the rod is pushed to move the high pressure can in the drain cleaner of the present invention.
Figure 5:
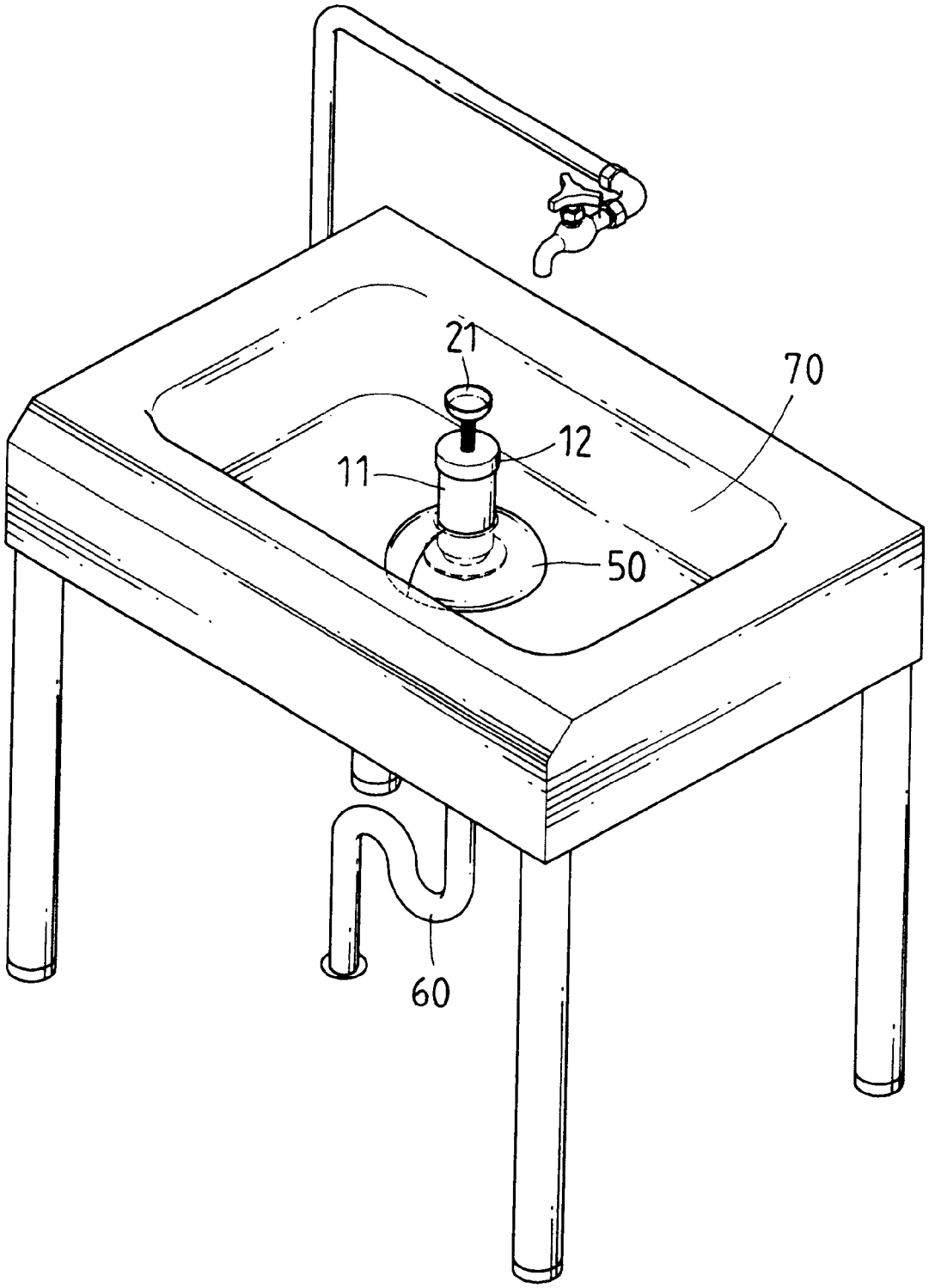
FIG. 5 shows that the drain cleaner of the present invention is used in a sink.
Figure 6:
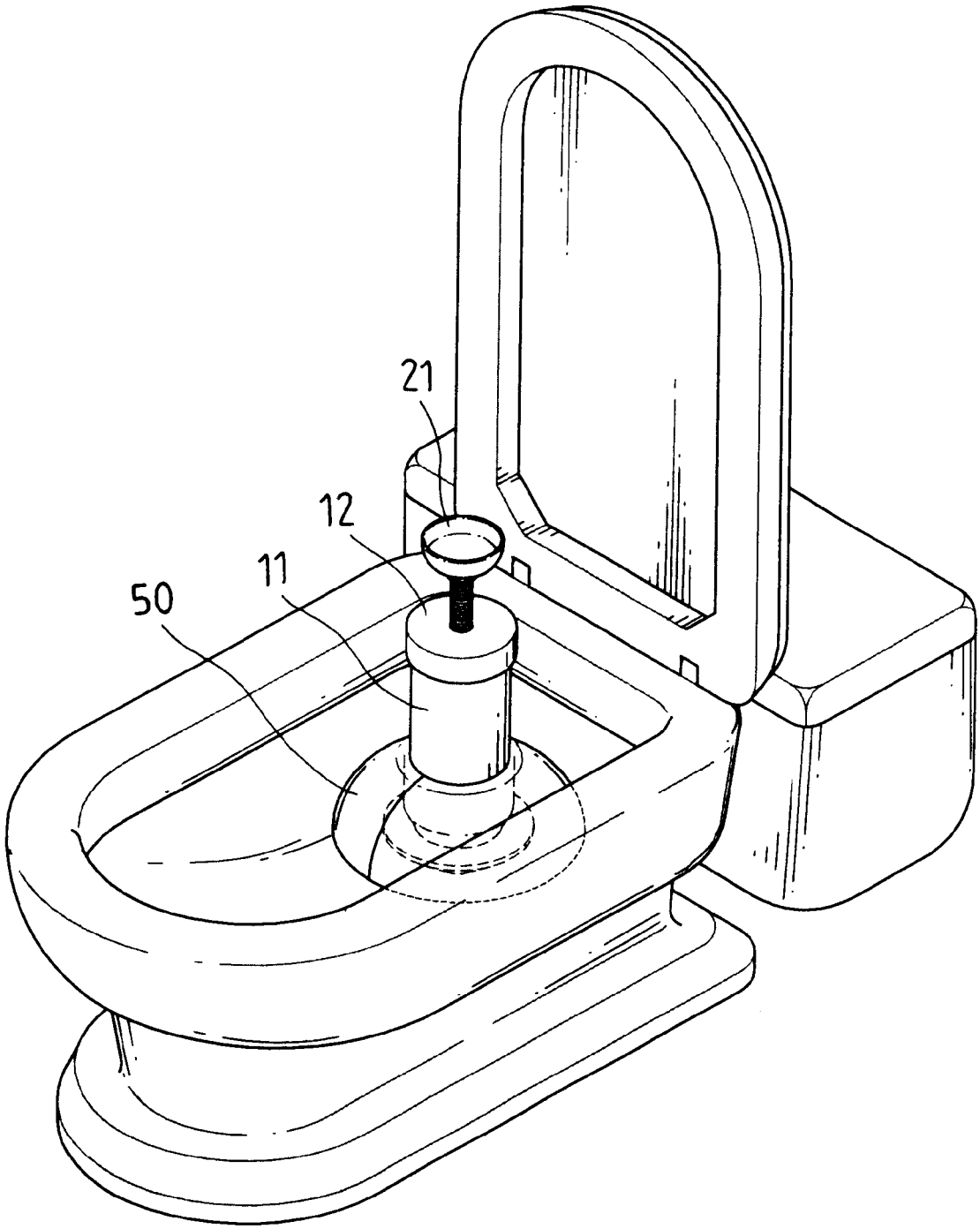
FIG. 6 shows that the drain cleaner of the present invention is used in a toilet bowl.

As shown in FIGS. 4 and 5, when using the drain cleaner in a sink 70, the cone-shaped pad 40 is engaged with the draining hole 71 of the sink 70 by the cone-shaped periphery 43 of the pad 40, the rod 22 is then pushed by pushing the knob 21 to lower the can 30. The valve 32 is then activated by the shrink opening 112 in the tube 113 and a high pressure is generated into the drain 60 to remove the stocked stuff. When releasing the knob 21, the spring 116 raises the can 30 away from the tube 113. The drain cleaner can also be used in a toilet bowl as shown in FIG. 6 by the same procedures. The skirt 50 prevents the contaminated stuff splashed out from gaps between the pad 40 and the drain opening 71.

While we have shown and described the embodiment in accordance with the present invention, it should be clear to those skilled in the art that further embodiments may be made without departing from the scope of the present invention.

What is claimed is:

1. A drain cleaner comprising:

a casing having an aperture defined in a first end thereof and a tube engaged with the opening, the tube having a shrink opening on a top surface thereof;

a high pressure can received in the casing and a valve connected to a first end of the can, a spring connected between the can and an inside of the first end of the casing, the valve located in alignment with the shrink opening of the tube, a rod movably extending through a second end of the casing and located at a second end of the can, and a drain engagement device.

2. The drain cleaner device as claimed in claim 1 further comprising a bush mounted on the tube and located on the inside of the first end of the casing, the spring mounted on the bush.

3. The drain cleaner as claimed in claim 1 wherein the drain engagement device comprises a cone-shaped pad connected to the first end of the casing.

4. The drain cleaner as claimed in claim 3 further comprising a connection member fixedly mounted on the tube and located at an outside of the first end of the casing, the connection member having threads on an outer periphery thereof and the pad having a threaded passage which is engaged with the threads of the connection member.

5. The drain cleaner as claimed in claim 1 wherein the second end of the can has a concavity and the rod is connected to a curved plate which contacts the concavity of the can.

6. The drain cleaner as claimed in claim 5 wherein the curved plate has an inner-threaded tube extending therefrom and the rod is threadedly engaged with the i8nner-threaded tube.

7. The drain cleaner as claimed in claim 1 further comprising a cap removably mounted to the second end of the casing and the rod movably extends through the cap.

8. The drain cleaner as claimed in claim 1 further comprising a skirt member mounted on the casing.

9. The drain cleaner as claimed in claim 8, wherein the casing has an annular groove defined in an outer periphery thereof and the skirt member includes two halves which are respectively engaged with the annular groove in the casing.

10. The drain cleaner as claimed in claim 1 further comprising a plurality of ribs extending from an inside of the casing and the can being enclosed by the ribs.

* * * * *